US009810026B2

(12) United States Patent
Zahradnik

(10) Patent No.: US 9,810,026 B2
(45) **Date of Patent: *Nov. 7, 2017**

(54) EARTH-BORING TOOLS AND METHODS OF FORMING EARTH-BORING TOOLS

(71) Applicant: Baker Hughes Incorporated, Houston, TX (US)

(72) Inventor: Anton F. Zahradnik, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 185 days.

This patent is subject to a terminal disclaimer.

(21) Appl. No.: 14/589,059

(22) Filed: Jan. 5, 2015

(65) Prior Publication Data

US 2015/0107909 A1 Apr. 23, 2015

Related U.S. Application Data

(63) Continuation of application No. 13/315,022, filed on Dec. 8, 2011, now Pat. No. 8,925,654.

(51) Int. Cl.

| | |
|---|---|
| ***E21B 10/00*** | (2006.01) |
| ***E21B 10/62*** | (2006.01) |
| ***E21B 10/42*** | (2006.01) |
| ***B22D 19/00*** | (2006.01) |
| ***E21B 10/567*** | (2006.01) |

(52) U.S. Cl.

CPC ..... *E21B 10/62* (2013.01); *B22D 19/00* (2013.01); *E21B 10/42* (2013.01); *E21B 10/567* (2013.01); *Y10T 29/49* (2015.01); *Y10T 29/49826* (2015.01)

(58) Field of Classification Search

CPC ..... E21B 10/00; E21B 10/42

See application file for complete search history.

(56) References Cited

U.S. PATENT DOCUMENTS

| | | | | |
|---|---|---|---|---|
| 6,349,780 | B1 | 2/2002 | Beuershausen | |
| 6,460,631 | B2 | 10/2002 | Dykstra et al. | |
| 6,564,886 | B1 | 5/2003 | Mensa-Wilmot et al. | |
| 7,571,782 | B2 | 8/2009 | Hall et al. | |
| 8,225,886 | B2 | 7/2012 | Mirchandani et al. | |
| 8,925,654 | B2 * | 1/2015 | Zahradnik ..... | E21B 10/42 175/331 |
| 2006/0162966 | A1 * | 7/2006 | Richert ..... | E21B 10/46 175/348 |
| 2008/0135305 | A1 | 6/2008 | Smith et al. | |

(Continued)

*Primary Examiner* — John Kreck

(74) *Attorney, Agent, or Firm* — TraskBritt

(57) ABSTRACT

A fixed-cutter earth-boring tool includes a first blade substantially comprising a first material having a first elastic modulus at a temperature, and a second blade substantially comprising a second material having a second elastic modulus at the temperature. The second elastic modulus is different from the first elastic modulus. A method of forming an earth-boring tool includes forming a bit body having a plurality of blades, and providing at least one cutting element on at least one of the plurality of blades. Some fixed-cutter earth-boring drill bits include a first blade exhibiting a first deflection when subjected to a load, and a second blade exhibiting a second deflection when subjected to the load. The first deflection may be a continuous function of the load, and the second deflection may be a discontinuous function of the load.

18 Claims, 7 Drawing Sheets

(56) References Cited

U.S. PATENT DOCUMENTS

| | | | | |
|---|---|---|---|---|
| 2008/0164071 | A1 | 7/2008 | Patel et al. | |
| 2008/0314645 | A1* | 12/2008 | Hall | E21B 10/43 175/374 |
| 2009/0301789 | A1 | 12/2009 | Smith et al. | |
| 2010/0006345 | A1 | 1/2010 | Stevens | |
| 2010/0108401 | A1 | 5/2010 | Lanning et al. | |
| 2011/0174548 | A1 | 7/2011 | Patel et al. | |
| 2011/0192651 | A1 | 8/2011 | Lyons et al. | |
| 2013/0146370 | A1 | 6/2013 | Zahradnik | |

* cited by examiner

EARTH-BORING TOOLS AND METHODS OF FORMING EARTH-BORING TOOLS

CROSS-REFERENCE TO RELATED APPLICATION

This application is a continuation of U.S. patent application Ser. No. 13/315,022, filed Dec. 8, 2011, now U.S. Pat. No. 8,925,654, issued Jan. 6, 2015 the disclosure of which is hereby incorporated herein in its entirety by this reference.

FIELD

The present disclosure relates generally to tools for use in earth-boring operations, such as fixed-cutter drill bits and bit bodies.

BACKGROUND

Earth-boring tools for forming boreholes in subterranean earth formations, such as for hydrocarbon production, carbon dioxide sequestration, etc., generally include a plurality of cutting elements secured to a body. For example, fixed-cutter earth-boring rotary drill bits (also referred to as "drag bits") include cutting elements fixed to a bit body of the drill bit. The cutting elements may be affixed to blades disposed along an outer diameter of the bit body.

Bit bodies and blades may be formed of metal-matrix composites having a continuous phase and a dispersed phase. The continuous phase may be a metal or an alloy, such as a copper alloy, steel, cobalt, a cobalt-nickel alloy, etc. The dispersed phase may be a reinforcing material, and may be a different metal or another material, such as a ceramic. The dispersed phase may be selected to impart a particular property to the composite, such as hardness, wear resistance, strength, thermal conductivity, etc. For example, the dispersed phase may include materials such as tungsten carbide, cubic boron nitride, silicon carbide, diamond, etc. The dispersed phase may include particles, fibers, whiskers, etc. Bit bodies and blades may also be formed from steel.

During drilling operations, drill bits may be subjected to harsh conditions, such as high temperatures, high pressures, and corrosive fluids. Under some operating conditions, hard formation material may cause deflection of blades, and may cause damage to blades. Various methods have been developed to prevent damage to drill bits during drilling. For example, wear-resistant inserts may be disposed on blades to stabilize the drill bit and control bit aggressiveness. Such inserts may cause blades to engage the formation material to a preselected depth. Limiting the depth of the formation engaged by each blade may limit the potential damage to the blade, but may also limit the rate of penetration (ROP) of the drilling operation.

U.S. Pat. No. 7,571,782, issued Aug. 11, 2009, and entitled "Stiffened Blade for Shear-Type Drill Bit," the disclosure of which is incorporated herein in its entirety by this reference, describes a steel bit body with stiffening elements to increase the stiffness of the blades. The blades may be less susceptible to wear and damage than unstiffened blades, and the bit may have a longer service life. Stiffening elements may include, for example, backing plates, brackets, carbide segments, or carbide rods. Drilling with blades having high stiffness may cause a more uniform or constant impact of cutting elements on the formation. Thus, ROP may be increased, and damage to drill bits may be limited.

BRIEF SUMMARY

In some embodiments of the disclosure, a fixed-cutter earth-boring tool includes a first blade carrying a first plurality of cutting elements and having a first stiffness and a second blade configured to have a second stiffness different from the first stiffness.

A method of forming an earth-boring tool may include forming a bit body having a plurality of blades, and providing at least one cutting element on at least one of the plurality of blades. At least one blade of the plurality has a stiffness different from a stiffness of another blade of the plurality.

In other embodiments, a fixed-cutter earth-boring drill bit may include a first blade having a first aggressiveness, and at least one additional blade having a second aggressiveness. The second aggressiveness is less than the first aggressiveness.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments when read in conjunction with the accompanying drawings, in which:

DETAILED DESCRIPTION

Figure 1:
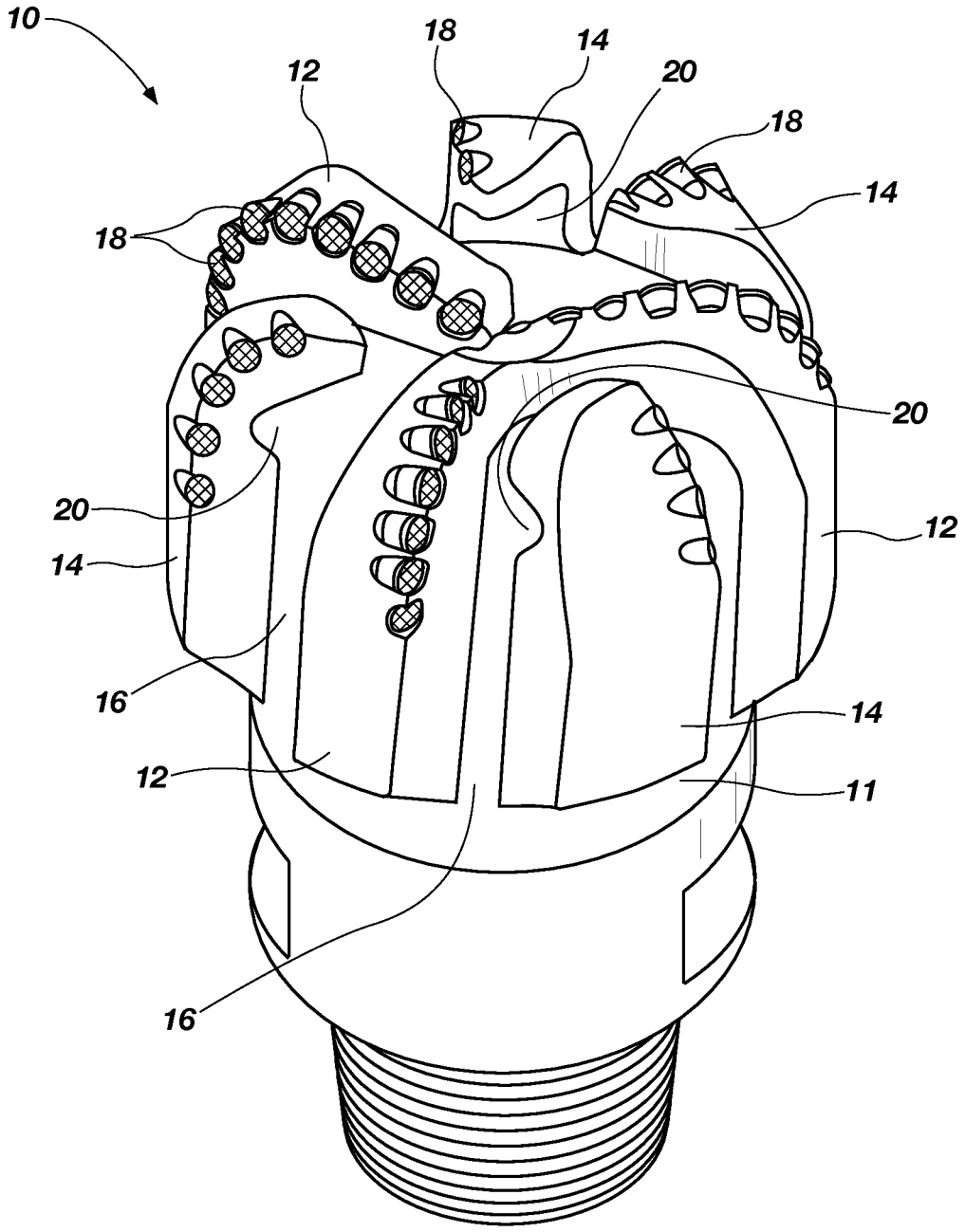
FIG. 1 is a perspective view of an embodiment of an earth-boring tool of the present disclosure comprising a rotary fixed-cutter drill bit that includes deflectable blades.

The illustrations presented herein are not actual views of any particular material, bit body, blades, or drill bit, and are not drawn to scale, but are merely idealized representations employed to describe embodiments of the disclosure. Elements common between figures may retain the same numerical designation.

As used herein, the term "drill bit" means and includes any type of bit or tool used for drilling during the formation or enlargement of a wellbore and includes, for example, rotary drill bits, percussion bits, core bits, eccentric bits, bicenter bits, reamers, expandable reamers, mills, drag bits, roller cone bits, hybrid bits, and other drilling bits and tools known in the art.

As used herein, the term "bit aggressiveness" ($\mu$) of a drill bit is defined according to the following formula: $\mu=36\cdot T/D\cdot W$; wherein T equals the torque applied to the drill bit, D equals the diameter of the bit, and W equals the weight-on-bit (WOB). Bit aggressiveness is a unitless number. Bit aggressiveness may be affected by factors such as vibration, number of blades or cones, cutter size, type, and configuration, hardness of the subterranean formation, etc. These factors may affect the bit aggressiveness by changing the torque delivered at a particular WOB. Different types of bits may have different bit aggressiveness. Conventional roller cone bits may have a bit aggressiveness of from about 0.10 to about 0.25, impregnated bits may have a bit aggressiveness of from about 0.12 to about 0.40, and PDC bits may have a bit aggressiveness of from about 0.40 to about 1.50 (assuming, in each case, similar cutter type on each blade or roller cone of a bit, and somewhat evenly distributed WOB is between each blade or roller cone). Hybrid bits (bits having a combination of roller cones and PDC blades) may have a bit aggressiveness between that of a roller cone bit and a PDC bit.

As used herein, the term "blade aggressiveness" of a blade of a drill bit is that portion of the bit aggressiveness attributable to an individual blade. The blade aggressiveness and the weight applied to the individual blade may contribute to the overall bit aggressiveness.

As used herein, the term "cutting element aggressiveness" of a cutting element of a drill bit is that portion of the bit aggressiveness attributable to an individual cutting element. Cutting element aggressiveness may depend on the type of cutting element, configuration (e.g., back rake), size, and/or position.

As used herein, the term "stiffness" means and includes the resistance of a body to deformation. Stiffness of a body may be a function of the geometry of the body and/or the composition of the material of which the body is formed. Thus, two bodies having the same size and shape may have different stiffnesses if they are formed of different materials. Similarly, two bodies formed of the same material may have different stiffnesses if they have different sizes or shapes. The stiffness (k) of a body is defined according to the formula:

$$k = \frac{P}{\delta} = \frac{A \cdot E}{L},$$

wherein P equals the load applied to the body, δ equals the deflection of the body, A equals the cross-sectional area of the body, E equals the modulus of elasticity of the material of the body, and L equals the length of the body. Thus, stiffness may be calculated from load and deflection data or from material properties and body geometry. Stiffness has units of force divided by length. Bits may not have uniformly shaped blades; therefore, load deflection data and/or finite element analysis may be used to determine the stiffness of a blade.

In accordance with the present disclosure, an earth-boring tool may have one or more blades configured such that the overall bit aggressiveness of the tool is less than the bit aggressiveness of a conventional PDC, such as by incorporating at least one blade that has a lower blade aggressiveness than a conventional PDC blade. In some embodiments, bit aggressiveness may be varied during drilling by changing the WOB. Variable bit aggressiveness may be due to one or more blades or blade regions having different stiffness than other blades or regions, and/or different cutter types or arrangements on different blades or blade regions. In some embodiments, fixed-cutter earth-boring tools, such as drill bits, may have one or more blades configured to deflect under a load. Such deflection may cause a change in the overall bit aggressiveness by altering the distribution of forces (e.g., WOB) among the blades. Tools having deflectable blades may be used in applications wherein it may be advantageous to adjust the overall bit aggressiveness within a wellbore during a drilling operation.

FIG. 1 illustrates an embodiment of an earth-boring tool having blades configured to deflect under load. The earth-boring tool shown in FIG. 1 is a rotary drill bit 10 having a bit body 11 that includes a plurality of blades, such as primary blades 12 and secondary blades 14, separated from one another by fluid courses 16. Primary blades 12 are those blades that extend proximate the longitudinal axis of the drill bit 10 to the cone region of the drill bit 10. A primary blade 12 may meet another primary blade 12 in the cone region. Secondary blades 14 are those blades that do not extend into the cone region of the drill bit 10. The portions of the fluid courses 16 that extend along the radial sides (the "gage" areas of the drill bit 10) between adjacent blades 12, 14 are often referred to in the art as "junk slots." A plurality of cutting elements 18 are mounted to each of the primary blades 12, and optionally, to the secondary blades 14. The bit body 11 further includes a generally cylindrical internal fluid plenum (not shown) and fluid passageways (not shown) that extend through the bit body 11 to an exterior surface of the bit body 11. Nozzles (not shown) may be secured within the fluid passageways proximate the exterior surface of the bit body 11 for controlling the hydraulics of the drill bit 10 during drilling.

During a drilling operation, the drill bit 10 may be coupled to a drill string (not shown). As the drill bit 10 is rotated within the wellbore, drilling fluid may be pumped down the drill string, through the internal fluid plenum and fluid passageways within the bit body 11 of the drill bit 10, and out from the drill bit 10 through the nozzles. Formation cuttings generated by contact of the cutting elements 18 with the formation may be carried with the drilling fluid through the fluid courses 16, around the drill bit 10, and back up the wellbore through an annular space within the wellbore and outside the drill string.

The drill bit 10 shown in FIG. 1 has three primary blades 12 (two of which are connected to one another in the cone region) and four secondary blades 14. The blades 12, 14 may be formed of the same material or a different material as the bit body 11. One or more of the blades 12, 14 may be configured to have a different stiffness than other blades 12, 14. As a non-limiting example, the primary blades 12 may be configured to have a first relatively higher average stiffness and/or blade aggressiveness, and the secondary blades 14 may be configured to have a second relatively lower average stiffness and/or blade aggressiveness. The stiffnesses of the primary blades 12 may be the same or different from one another, and the stiffnesses of the secondary blades 14 may be the same or different from one another. Similarly, the blade aggressiveness of the primary blades 12 may be the same or different from one another, and the blade aggressiveness of the secondary blades 14 may be the same or different from one another. The stiffness of a blade 12, 14 and the blade aggressiveness may depend on both geometry and material properties, as well cutter type and placement.

Various bit and blade geometries may be selected to achieve a desired stiffness. The blades 12, 14 of the drill bit 10 shown in FIG. 1 may have different stiffnesses from one another by virtue of their different geometries. In some embodiments, a blade having a lower stiffness than other blades (e.g., a secondary blade 14 of the drill bit 10 shown in FIG. 1) may be formed of the same material as a blade having a higher stiffness (e.g., a primary blade 12). In such embodiments, the difference in stiffness may be due to differences in the geometry of the blades.

A drill bit 10 having blades 12, 14 with different aggressiveness may have an overall bit aggressiveness between the bit aggressiveness of a similarly configured conventional drill bit having only the more aggressive blades and the bit aggressiveness of a conventional drill bit having only the less aggressive blades.

Figure 2:
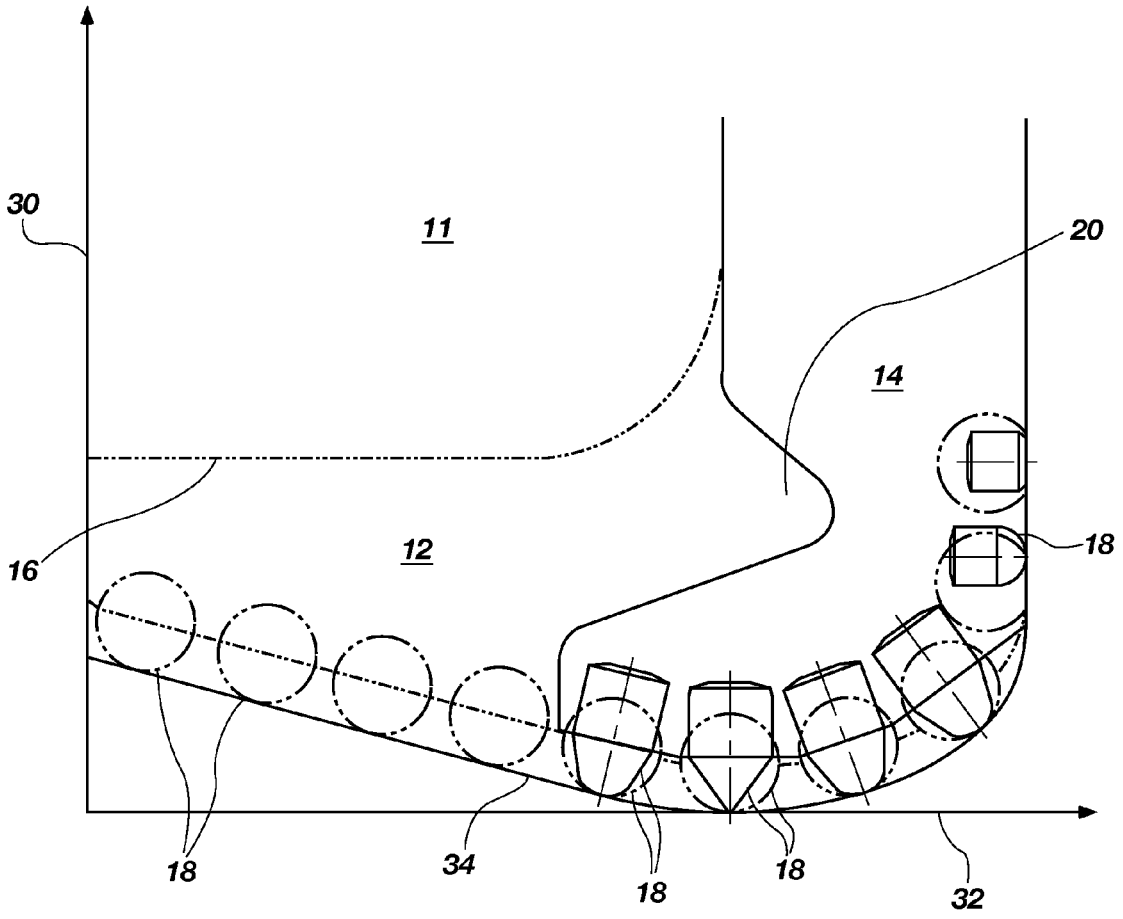
FIG. 2 is a simplified drawing showing a cutting element layout for an earth-boring tool of the present disclosure.

FIG. 2 shows a schematic partial side cross-sectional view a drill bit of the present disclosure (which may be similar to the drill bit 10 of FIG. 1) as if cutting elements 18 disposed on multiple blades 12, 14 (for example, cutting elements disposed on one primary blade 12 and on one secondary blade 14) were rotated onto a single blade protruding from a bit body 11, extending from a centerline of the bit body to the gage. Such a view is commonly termed a "cutter layout" drawing or "cutter profile" drawing and may be used to design rotary drill bits, as known in the art. Each of the cutting elements 18 is shown in relation to vertical axis 30 and horizontal axis 32. The vertical axis 30 represents an axis, conventionally the centerline of the bit, about which the drill bit 10 rotates. The distance from each cutting element 18 to the vertical axis 30 corresponds to the radial position of each cutting element 18 on the drill bit 10. The distance from each cutting element 18 to the horizontal axis 32 corresponds to the longitudinal position of each cutting element on the drill bit. Cutting elements 18 may be positioned along a selected profile 34, as known in the art. As shown in FIG. 2, radially adjacent cutting elements 18 may overlap one another along the cutter profile (although not in the actual physical bit, as such cutting elements may be located on different blades, for example). Furthermore, two or more cutting elements 18 of a drill bit may be positioned at substantially the same radial and longitudinal position. One cutting element 18 may be of a different type, material, shape, and/or orientation from another cutting element 18. Blades 12, 14 having cutting elements 18 with different types, materials, shapes, positions, or orientations may exhibit different blade aggressiveness.

A primary blade 12 and the cutting elements 18 thereon are shown as dashed lines and circles in the cutting element diagram of FIG. 2. The boundary of the fluid course 16 is also shown in a dashed line. The cutting elements 18 on the secondary blade 14 are shown in solid lines and may have various shapes, such as tapered surfaces, points, flat surfaces, etc. As shown in FIG. 2 and in the perspective view of FIG. 1, the secondary blade 12 may be shaped such that there is a cutout or space 20 between a portion of the secondary blade 14 and the bit body 11. A secondary blade 14 shaped to define a space 20 may have a lower stiffness than a secondary blade having a shape that does not define such a space 20.

When a force is applied to the secondary blade 14, such as weight-on-bit (WOB) during a drilling operation, a portion of the secondary blade 14 may deflect or bend into a portion of the space 20 (e.g., decreasing a dimension of the space 20). Such deflection may change the exposure of other blades, such as primary blades 12, to material of the formation. Thus, the area of the primary blades 12 exposed to the formation (e.g., in contact with and rubbing on the formation) may be varied by varying the load applied to the drill bit. The bit aggressiveness may be increased by deflecting the secondary blades 14. In a drill bit having blades 12, 14 of different stiffnesses, the bit aggressiveness may be varied during a drilling operation by varying the WOB. The capability of varying the bit aggressiveness may allow better tool face control, which may allow a higher overall rate of penetration. Such control may limit the necessity of changing drill bits during a drilling operation, and may thus lower the time required to drill a wellbore, lower costs, increase operational flexibility (e.g., the ability to change drilling parameters during operation in response to data collected), etc.

Figure 3:
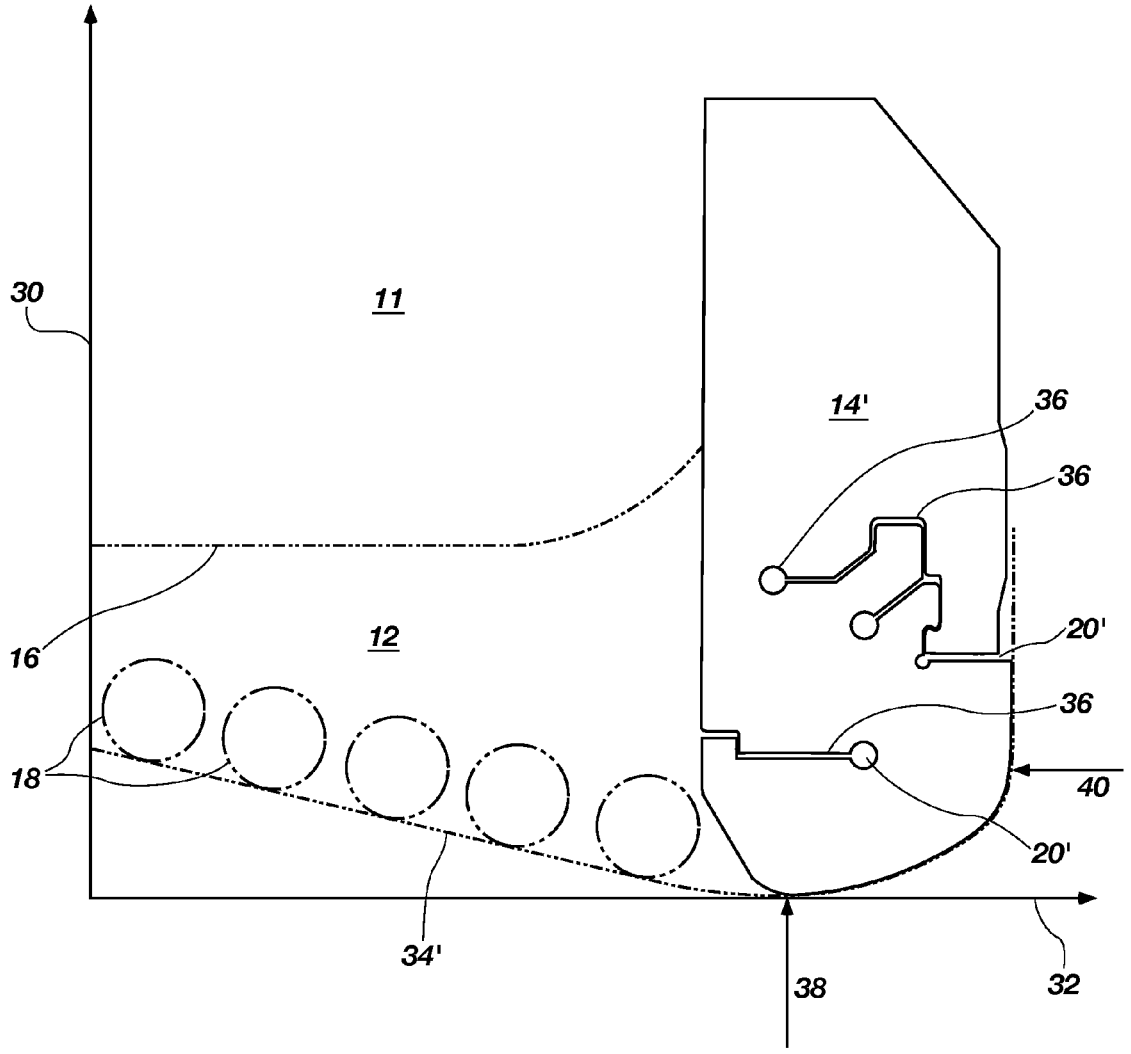
FIG. 3 is a simplified drawing showing a cutting element layout for an earth-boring tool with a secondary blade configured to have a limited deflection.

FIG. 3 shows a cross section of a secondary blade 14' of another embodiment of a drill bit superimposed on a portion of a cutting element diagram of the drill bit. A profile 34' is shown on the cutting element layout. Cutting elements 18 in the cone region of the primary blade 12 are shown in dashed lines, but other cutting elements 18 have been omitted to clarify the drawing. In particular, no cutting elements are shown on the secondary blade 14' or on portions of the primary blade 12 overlapping the secondary blade 14' so that the features of the secondary blade 14' may be better conveyed. Cutting elements 18 on the secondary blade 14' may be of a similar type, material, shape, radial and/or axial position, or orientation to cutting elements 18 on the primary blade 12, or may be of a different type, material, shape, radial and/or axial position, or orientation. Cutting elements 18 may be present in such locations in embodiments of the present disclosure, even though they are not depicted in FIG. 3. The secondary blade 14' shown in FIG. 3 has a plurality of interior surfaces 36 defining a plurality of spaces 20', which may be characterized as gaps, voids, inner pathways, slots, holes, etc. The interior surfaces 36 may be flat or curved, and may be connected to one another. Some interior surfaces 36 may define substantially planar spaces 20', whereas others may define cylindrical spaces 20'. Interior surfaces 36 may be formed by machining, such as by drilling, milling, etc. In some embodiments, the interior surfaces 36 may be formed by casting material of the secondary blade 14' around a removable material, as subsequently removing the removable material. The presence of spaces 20' within the secondary blade 14' may decrease the stiffness of the secondary blade 14'. When a force is applied to the secondary blade 14', the secondary blade 14' may deflect or bend, diminishing the volume of one or more of the spaces 20' defined by the interior surfaces 36.

The spaces 20' may be configured to tailor deflection as a function of applied force. As the volume of one or more spaces 20' decreases, opposing interior surfaces 36 may contact one another. That is, spaces 20' may collapse under a force, and the secondary blade 14' may exert a discontinuity in the resistance to the force. For example, the resistance of the secondary blade 14' may vary linearly with the WOB up to a point that opposing interior surfaces 36 contact one another. Once opposing interior surfaces 36 contact one another, the secondary blade 14' having spaces 20' therein may exert a much larger resistance to the WOB. In some embodiments, the resistance of a secondary blade 14' having spaces 20' that have collapsed may be similar to the resistance of a secondary blade without spaces 20'. The collapse of spaces 20' may be reversible, such that when WOB is reduced, the interior surfaces 36 separate from one another and the resistance of the secondary blade 14' reduces.

The secondary blade 14' may be configured to deflect based on forces at various locations. For example, as shown in FIG. 3, a force 38 acting on the nose region of the drill bit may cause a first set of spaces 20' to change in volume, whereas a force 40 acting on the shoulder or gage region of the drill bit may cause a second set of spaces 20' to change in volume. Thus, the secondary blade 14' may deflect in multiple directions, based on its design and on the location and magnitude of forces acting upon it.

The deflection of the secondary blade 14' may change the bit aggressiveness of the drill bit upon which the secondary blade 14' is carried. Secondary blades 14' may act as depth-of-cut limiters to control the bit aggressiveness and/or ROP of the drill bit. For example, as WOB increases, the secondary blades 14' may deflect more, and such deflection may increase the depth of cut of cutting elements 18 on the primary blades 12.

Figure 4:
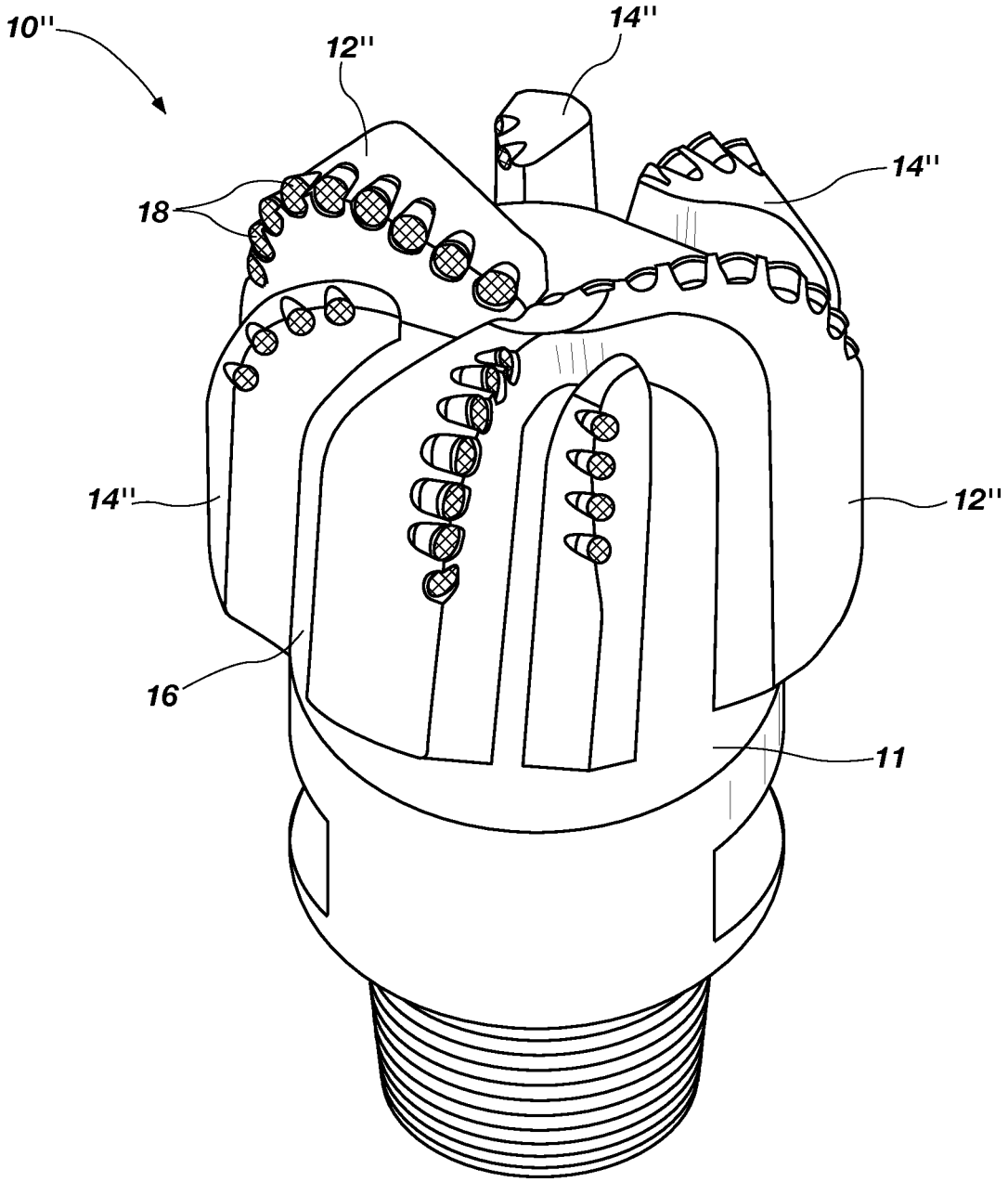
FIGS. 4 and 5 are additional perspective views of additional embodiments of earth-boring tools of the present disclosure comprising rotary fixed-cutter drill bits that include deflectable blades.

In some embodiments, the stiffness of the blades may depend on the transverse thickness of the blades (e.g., a distance measured circumferentially along the outside surface of the drill bit). A narrower blade (e.g., a blade having a smaller transverse thickness and/or a smaller contact area with the subterranean formation) may have a lower stiffness than a wider blade. For example, as shown in FIG. 4, primary blades 12" of a drill bit 10" may be wider than secondary blades 14".

Figure 5:
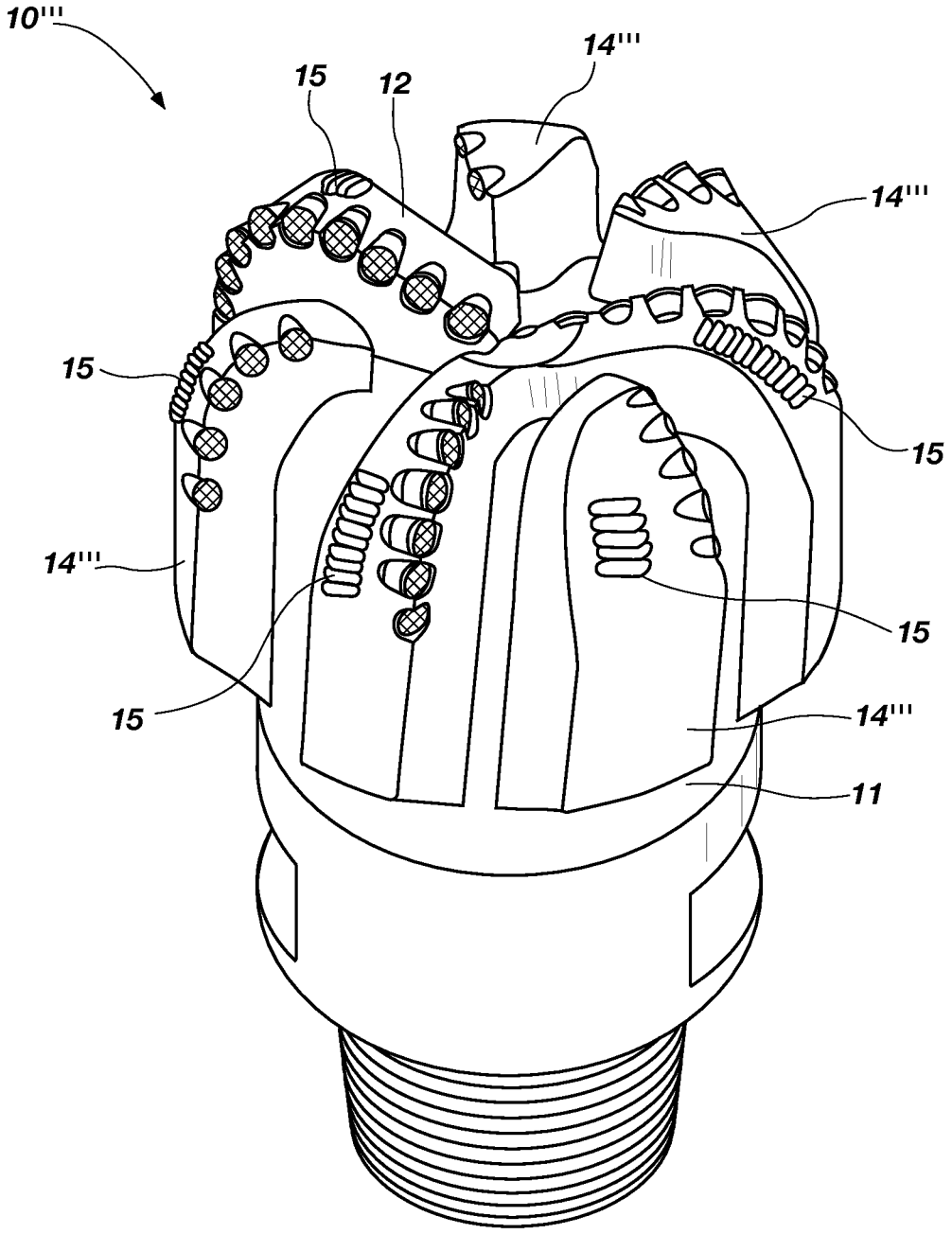

Besides geometry, stiffness of a body may be determined in part by the elastic modulus of material of the body. As used here, the term "elastic modulus" is synonymous with the term "Young's modulus," and is defined as the slope of the stress-strain curve in the elastic deformation region of the material. Elastic modulus is a property of a material, and may be a function of temperature. In some materials, elastic modulus may decrease with increasing temperature, meaning that a given body may deform more under a given load at a higher temperature than under the same given load at a lower temperature. In some embodiments, and as shown in FIG. 5, a blade having a lower stiffness than other blades (e.g., a secondary blade 14''' of the drill bit 10''') may be formed of a material having a lower elastic modulus at a selected temperature (e.g., at 23° C.) than a material of a blade having a higher stiffness (e.g., a primary blade 12). For example, one blade may be formed of a material having an elastic modulus 50% higher than the material of another blade, or may be formed of a material having an elastic modulus 100% higher than the material of another blade. Blades may be formed of various materials, such as aluminum, steel, composite, matrix materials, etc. Blades 12 and 14''' may carry one or more cutting elements 18, including cutting elements of the same or different type, material, shape, position, or orientation.

Cutting elements 18, as shown in FIGS. 1 through 5, may include tungsten carbide inserts, diamond inserts, impregnated inserts, polycrystalline diamond compacts, thermally stable products, etc. As shown in FIG. 2, cutting elements 18 carried by a primary blade 12 may be of a different type, material, or orientation from cutting elements 18 carried by a secondary blade 14. Furthermore, cutting elements 18 on a single blade 12, 14 may be different from other cutting elements 18 on that blade 12, 14, such as described in U.S. Patent Application Pub. No. 2011/0192651, published Aug. 11, 2011, and entitled "Earth-Boring Tools and Methods of Forming Such Earth-Boring Tools," the disclosure of which is incorporated herein in its entirety by this reference. For example, cutting elements 18 carried by the primary blade 12 may be configured to cut material of a subterranean formation primarily by a shearing mechanism when the earth-boring tool is used to form or enlarge a bore in the formation. Cutting elements 18 carried by the secondary blade 14 may be configured to cut the formation primarily by a gouging mechanism, or may be configured primarily to slide along the formation and balance the drill bit or limit the amount of bit vibration. In some embodiments, one or more of the blades 12, 14 may include depth-of-cut limiters or wear pads 15 (see FIG. 5) to limit the blade aggressiveness, such as described in U.S. Pat. No. 6,460,631, issued Oct. 8, 2002, and entitled "Drill Bits with Reduced Exposure of Cutters," the disclosure of which is incorporated herein in its entirety by this reference.

In some embodiments, the cutting elements 18 carried by a primary blade 12 may be of the same type as cutting elements 18 carried by a secondary blade 14. Cutting elements 18 may have the same or different configurations (e.g., back rake angles, side rake angles, etc.) and have the same or different cutting element aggressiveness. Some cutting elements 18 may follow the same paths as other cutting elements 18. Cutting elements 18 carried by a secondary blade 14 may be arranged and configured to be backup cutting elements, primary cutting elements, or a mixture of backup and primary cutting elements.

A blade (e.g., a secondary blade 14) having a lower stiffness than another blade (e.g., a primary blade 12) may act as a dampener. For example, a surface of a subterranean formation may exert a force on the secondary blade 14 during a drilling operation, and the force may vary with the magnitude of deflection of the secondary blade 14. As the drill bit (e.g., the drill bit 10) rotates, the force on the secondary blade 14 may vary, and the magnitude of the deflection of the secondary blade 14 may vary according the shape of the surface. Thus, deflection of the secondary blade 14 may provide more consistent contact between the secondary blade 14 and the surface of the subterranean formation.

Drill bits including blades 12, 14 having different stiffnesses may be formed by machining, infiltration, casting, powder compaction, sintering, or any other method known in the art. For example, blades 12, 12", 14, 14', 14", 14''', may be separately formed by machining a steel billet. Geometric features, such as spaces 20, 20', interior surfaces 36, may be formed, if applicable. Blades 12, 14 may be attached to a bit body 11, such as by welding.

In another example, a bit body 11 may be formed by casting a metal into a mold. The mold may have cavities shaped to define one or more surfaces of the blades 12, 14 of the drill bit. The cavities may have varying transverse thicknesses (e.g., distances measured circumferentially along surfaces of the cavities corresponding to outside surfaces of the drill bit). In some embodiments, one or more displacement members may be placed within the mold, such as those disclosed in U.S. Patent Application Pub. No. 2008/0135305, published Jun. 12, 2008, and entitled, "Displacement Members and Methods of Using Such Displacement Members to Form Bit Bodies of Earth-Boring Rotary Drill Bits," and U.S. Patent Application Pub. No. 2011/0174548, published Jul. 21, 2011, and entitled, "Downhole Tools Having Features for Reducing Balling and Methods of Forming Such Tools" the disclosures of each of which are incorporated herein in their entirety by this reference. A powder mixture may be provided in the mold, and may include particles of a matrix material, particles of hard material, plasticizers, lubricants, etc. The mold and/or displacement members may define blades having various geometries, such as those described above with reference to FIGS. 1 through 5, such that the resulting blades have selected stiffnesses. The powder mixture may be compacted in the mold, such as by isostatic pressing. The powder mixture may subsequently be sintered to an intermediate or final density. The mold and/or displacement members may be removed from the bit body 11.

In some embodiments, different portions of a bit body 11 may be formed from different materials. In powder compaction processes used to form such bit bodies, multiple powder mixtures may be provided within the same mold, such as described in U.S. Patent Application Pub. No. 2010/0006345, published Jan. 14, 2010, and entitled, "Infiltrated, Machined Carbide Drill Bit Body," the disclosure of which is incorporated herein in its entirety by this reference. Different powder mixtures may be selected such that sintered material formed therefrom exhibits different elastic moduli. Thus, a bit body 11 formed in such embodiments may have blades with different stiffnesses at least by virtue of different properties of different materials of which the blades are composed.

Cutting elements may be provided on one or more blades 12, 14 during or after formation of the bit body 11. Cutting elements may be attached to the blades 12, 14 by any method now known or hereafter developed, such as by sintering, brazing, welding, etc. For example, inserts may be secured to the blades 12, 14 by methods described in U.S. Patent Application Pub. No. 2009/0301789, published Dec. 10, 2009, and entitled, "Methods of Forming Earth-Boring Tools Including Sinterbonded Components and Tools Formed by Such Methods," the disclosure of which is incorporated herein in its entirety by this reference.

The blades 12, 14 may be integrally formed with the bit body 11, or they may be formed separately from the bit body 11 and subsequently attached to the bit body 11. In some embodiments, for example, the primary blades 12 may have a relatively higher average stiffness and may be integrally formed with the bit body 11, while the secondary blades 14 may have a relatively lower average stiffness and may be separately formed from the bit body 11 and subsequently attached thereto. For example, the secondary blade 14' shown in FIG. 3 may be formed, such as by forging, infiltration, powder compaction and sintering techniques, casting, etc. Spaces 20' may be formed by drilling, machining, casting in place, etc. The secondary blade 14' may then be secured to the bit body 11 by brazing, welding, sintering, etc. In some embodiments, spaces 20' may be formed in a secondary blade 14' already attached to a bit body 11, though machining a blade 14' attached to a bit body 11' may be more difficult than machining a blade 14' before attachment to a bit body 11'.

Figure 6:
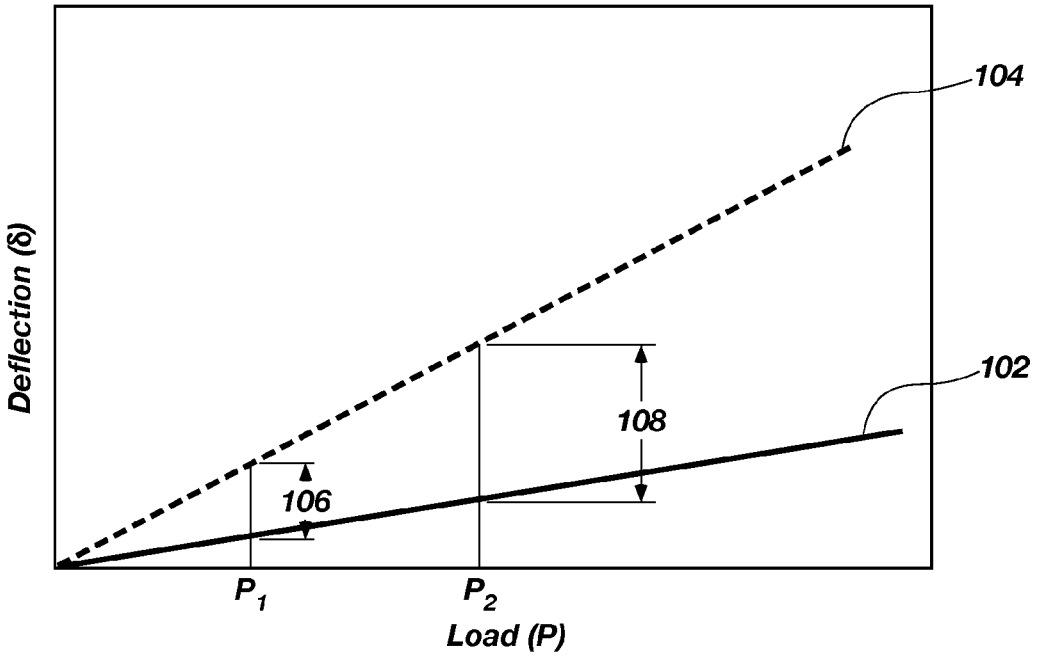
FIGS. 6 through 8 are charts showing blade deflection as a function of load for some deflectable blades of the present disclosure.
Figure 7:
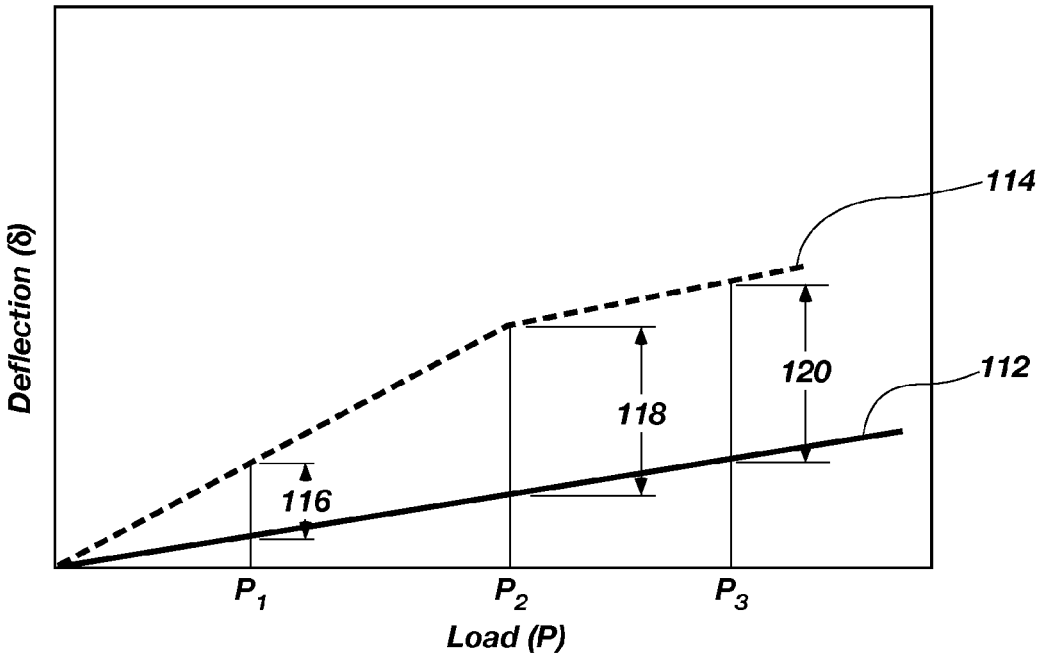
Figure 8:
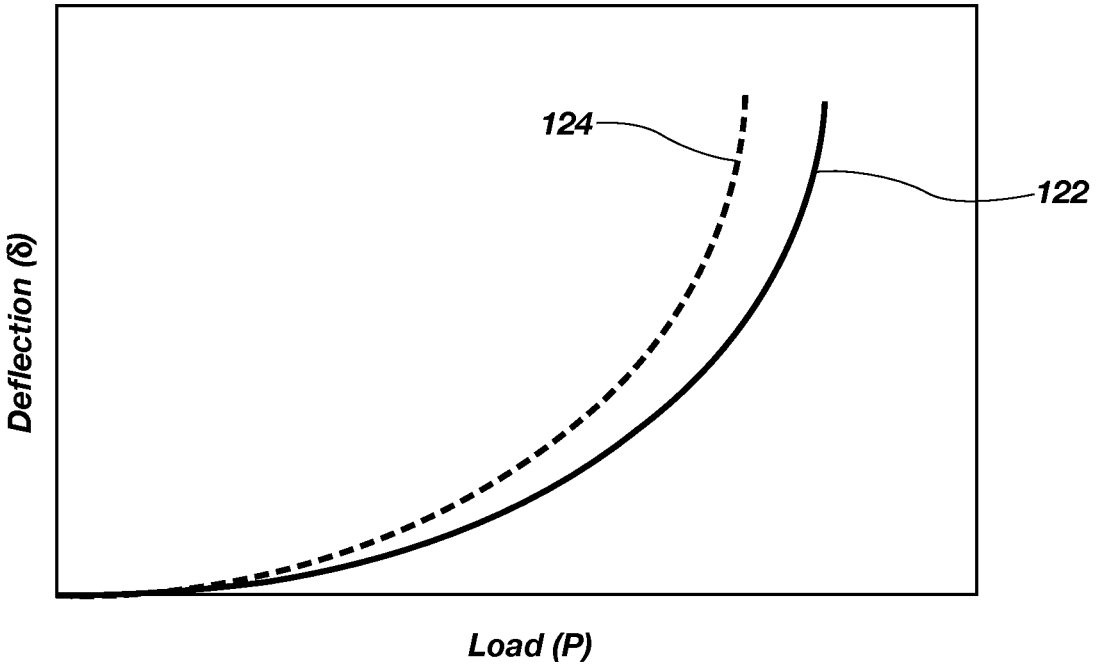

FIGS. 6 through 8 illustrate the deflection of blades under applied loads (e.g., WOB). FIG. 6 shows a first deflection 102 of a first blade and a second deflection 104 of a second blade. The first deflection 102 and the second deflection 104 may each vary in proportion with the load (P) on the blades. In such embodiments, a first differential deflection 106 at a first load $P_1$ may be less than a second differential deflection 108 at a second, higher load $P_2$. Because stiffness of a blade is defined as $$k = \frac{P}{\delta},$$

the stiffness of the blades may be the inverse of the slope of the deflection curves.

Similarly, FIG. 7 shows a first deflection 112 of a first blade and a second deflection 114 of a second blade, but the second deflection 114 may exhibit a discontinuity as a function of load (P). A first differential deflection 116 at a first load $P_1$ may be less than a second differential deflection 118 at a second, higher load $P_2$. A third differential deflection 120 at a third, still higher load $P_3$, may be approximately equivalent to the second differential deflection 118. As shown in FIG. 7, the load $P_2$ may correspond to a point at which the slope of the second deflection 114 changes. Thus, at loads higher than $P_2$, the slope of the second deflection 114 may be similar to the slope of the first deflection 112. In some embodiments, the slope of the second deflection 114 at loads higher than $P_2$ may be greater than or less than the slope of the first deflection 112. In such embodiments, the magnitude of third differential deflection 120 may vary accordingly. That is, the third differential deflection 120 may be less than or greater than the second differential deflection 118. The stiffness of the blades may be the inverse of the slope of the deflection curves. A blade may have a discontinuity in stiffness, for example, when a space 20' (see FIG. 3) has collapsed such that opposing interior surfaces 36 push on one another.

FIG. 8 shows a nonlinear first deflection 122 of a first blade and a nonlinear second deflection 124 of a second blade. The nonlinear deflections 122, 124 are shown as curved, but may exhibit any other shape or curvature. In FIGS. 6 through 8, the shape of the deflections may vary based on factors such as torque, bit type, diameter of the bit, vibration, number of blades, cutter size, cutter position and orientation (e.g., back rake), hardness of the formation, etc.

As shown in FIGS. 6 through 8, the deflection of one blade may be different than the deflection of another blade. In some embodiments, one blade of a drill bit may be configured to deflect about 0.001 inch (0.0254 mm) or more under an applied load on the blade of 1000 lbs (4448 N), such as about 0.005 inch (0.127 mm) or more. The load on the blade may be applied in the same direction that WOB is applied during a drilling operation. One blade of a drill bit may be configured to deflect at least 50% more than another blade under a load on the blade of 1000 lbs, such as at least 100% more than another blade.

In drill bits described herein, the weight supported by each blade may be a factor in the blade aggressiveness and overall bit aggressiveness. The weight supported by each blade may be a function of the stiffness of the blade. Assuming similar profiles, exposure, etc., a blade with a higher stiffness will tend to support more of the WOB than a blade with a lower stiffness. The deflection of a blade can be limited, such as by the addition of spaces 20', as described and shown in FIG. 3, thus changing the blade's stiffness. Each blade may have multiple regions as known in the art (cone, nose, shoulder, gage), and each region of each blade may have cutting elements with different aggressiveness, each cutting element contributing to the overall bit aggressiveness.

In one embodiment, a six-blade PDC bit may be designed to have increased bit aggressiveness as the WOB is increased. Three primary blades may have a higher stiffness than three secondary blades. As the WOB is increased, the secondary blades may deflect and more WOB would be carried by the primary blades. This may increase the overall bit aggressiveness. Additional changes in bit aggressiveness may be achieved by selecting less aggressive cutters for the secondary blades than for the primary blades.

Additional non-limiting example embodiments of the disclosure are described below.

Embodiment 1

A fixed-cutter earth-boring tool, comprising a first blade carrying a first plurality of cutting elements and having a first stiffness and a second blade configured to have a second stiffness different from the first stiffness.

Embodiment 2

The fixed-cutter earth-boring tool of Embodiment 1, wherein the first blade is a primary blade, the second blade is a secondary blade, and the first stiffness is higher than the second stiffness.

Embodiment 3

The fixed-cutter earth-boring tool of Embodiment 1 or Embodiment 2, wherein the first blade is configured to deflect a first distance under a selected load, and wherein the second blade is configured to deflect a second distance under the selected load, the second distance being greater than the first distance.

Embodiment 4

The fixed-cutter earth-boring tool of Embodiment 3, wherein the second distance is 0.001 inch (0.0254 mm) or more under a load on the blade of 1000 lbs.

Embodiment 5

The fixed-cutter earth-boring tool of Embodiment 4, wherein the second distance is 0.005 inch (0.127 mm) or more under a load on the blade of 1000 lbs.

Embodiment 6

The fixed-cutter earth-boring tool of any of Embodiments 1 through 5, wherein at least one surface of the second blade defines an open space and wherein the second blade is configured such that a force operative on the second blade causes a change in volume of the open space.

Embodiment 7

The fixed-cutter earth-boring tool of any of Embodiments 1 through 6, wherein the first blade comprises a first material having a first elastic modulus at a temperature, and the second blade comprises a second material having a second elastic modulus at the temperature, the first elastic modulus different from the second elastic modulus.

Embodiment 8

The fixed-cutter earth-boring tool of any of Embodiments 1 through 7, wherein the first blade has a first average transverse thickness, and the second blade has a second average transverse thickness. The second average transverse thickness is different from the first average transverse thickness.

Embodiment 9

The fixed-cutter earth-boring tool of any of Embodiments 1 through 8, wherein the second blade carries a second plurality of cutting elements.

Embodiment 10

The fixed-cutter earth-boring tool of Embodiment 9, wherein at least one cutting element of the second plurality of cutting elements comprises a tungsten carbide insert, a diamond insert, an impregnated insert, a polycrystalline diamond compact, or a thermally stable product.

Embodiment 11

The fixed-cutter earth-boring tool of any of Embodiments 1 through 10, wherein the second blade carries a depth-of-cut limiter or a wear pad.

Embodiment 12

A method of forming an earth-boring tool, comprising forming a bit body having a plurality of blades, and providing at least one cutting element on at least one of the plurality of blades. At least one blade of the plurality has a stiffness different from a stiffness of another blade of the plurality.

Embodiment 13

The method of Embodiment 12, wherein forming a bit body having a plurality of blades comprises providing a metal into a mold. The mold is configured to define at least a surface of the bit body.

Embodiment 14

The method of Embodiment 13, wherein forming a bit body having a plurality of blades comprises providing a metal into a mold having a plurality of cavities. Each cavity is configured to define at least a surface of a blade. At least one cavity has an average transverse thickness different from an average transverse thickness of another cavity.

Embodiment 15

The method of any of Embodiments 12 through 14, wherein forming a bit body having a plurality of blades comprises forming a first blade comprising a first material and a second blade comprising a second material different from the first material.

Embodiment 16

The method of Embodiment 15, further comprising selecting the first material to have a higher elastic modulus than the second material at room temperature.

Embodiment 17

The method of any of Embodiments 12 through 16, wherein securing at least one cutting element to at least one of the plurality of blades comprises attaching at least one of a tungsten carbide insert, a diamond insert, an impregnated insert, a polycrystalline diamond compact, or a thermally stable product to at least one of the plurality of blades.

Embodiment 18

The method of any of Embodiments 12 through 17, further comprising forming an open space within at least one of the plurality of blades.

Embodiment 19

A fixed-cutter earth-boring drill bit, comprising a first blade having a first aggressiveness, and at least one additional blade having a second aggressiveness. The second aggressiveness is less than the first aggressiveness.

Embodiment 20

The fixed-cutter earth-boring drill bit of Embodiment 19, wherein the first blade carries at least one cutting element.

Embodiment 21

The fixed-cutter earth-boring drill bit of Embodiment 19 or Embodiment 20, wherein the at least one additional blade carries at least one of a cutting element, a depth-of-cut limiter, and a wear pad.

Embodiment 22

The fixed-cutter earth-boring drill bit of any of Embodiments 19 through 21, wherein the at least one additional blade is configured to bend under a load.

Embodiment 23

The fixed-cutter earth-boring drill bit of Embodiment 22, wherein a cutting depth of the first blade is configured to increase under a load.

Embodiment 24

The fixed-cutter earth-boring drill bit of any of Embodiments 19 through 23, wherein the first blade carries at least one polycrystalline diamond compact cutting element, and the at least one additional blade carries at least one wear pad protruding from a surface thereof. The at least one wear pad has a substantially planar surface.

While the present disclosure has been described with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor. Further, embodiments of the disclosure have utility with different and various bit profiles as well as cutting element types and configurations.

What is claimed is:

1. A fixed-cutter earth-boring tool, comprising:

a first blade comprising a first blade body, the first blade body consisting essentially of a first material having a first elastic modulus at a temperature; and a second blade comprising a second blade body, the second blade body consisting essentially of a second material having a second elastic modulus at the temperature, the second elastic modulus different from the first elastic modulus, wherein the second blade body carries a depth-of-cut limiter or a wear pad.

2. The fixed-cutter earth-boring tool of claim 1, wherein:

the first blade is a primary blade;

the second blade is a secondary blade; and the first elastic modulus is higher than the second elastic modulus.

3. The fixed-cutter earth-boring tool of claim 1, wherein the first blade is configured to deflect a first distance under a selected load, and wherein the second blade is configured to deflect a second distance under the selected load, the second distance being greater than the first distance.

4. The fixed-cutter earth-boring tool of claim 3, wherein the second distance is 0.001 inch (0.0254 mm) or more under a load on the blade of 1000 lbs.

5. The fixed-cutter earth-boring tool of claim 4, wherein the second distance is 0.005 inch (0.127 mm) or more under a load on the blade of 1000 lbs.

6. A fixed-cutter earth-boring tool, comprising:

a first blade comprising a first blade body, the first blade body consisting essentially of a first material having a first elastic modulus at a temperature; and a second blade comprising a second blade body, the second blade body consisting essentially of a second material having a second elastic modulus at the temperature, the second elastic modulus different from the first elastic modulus;

wherein at least one surface of the second blade body defines an open space and wherein the second blade body is configured such that a force operative on the second blade body causes a change in volume of the open space.

7. The fixed-cutter earth-boring tool of claim 1, wherein the first blade body has a first transverse thickness, and the second blade body has a second transverse thickness, the second transverse thickness different from the first transverse thickness.

8. The fixed-cutter earth-boring tool of claim 1, wherein at least one of the first blade body and the second blade body carries at least one cutting element.

9. The fixed-cutter earth-boring tool of claim 8, wherein the second blade body carries at least one cutting element.

10. The fixed-cutter earth-boring tool of claim 8, wherein the at least one cutting element comprises at least one insert selected from the group consisting of a tungsten carbide insert, a diamond insert, an impregnated insert, a polycrystalline diamond compact, and a thermally stable product.

11. A method of forming an earth-boring tool, comprising:

forming a bit body having a plurality of blades, a first blade comprising a first blade body and a second blade comprising a second blade body, the first blade body consisting essentially of a first material having a first elastic modulus at a temperature, the second blade body consisting essentially of a second material having a second elastic modulus at the temperature, the second elastic modulus different from the first elastic modulus;

forming an open space within at least one of the first blade body or the second blade body; and providing at least one cutting element on at least one of the first blade body or the second blade body.

12. The method of claim 11, wherein forming a bit body having a plurality of blades comprises providing a metal into a mold, the mold configured to define at least a surface of the bit body.

13. The method of claim 12, wherein forming a bit body having a plurality of blades comprises providing a metal into a mold having a plurality of cavities, each cavity configured to define at least a surface of a blade, wherein at least one cavity has a transverse thickness different from a transverse thickness of another cavity.

14. The method of claim 11, wherein providing at least one cutting element on at least one of the first blade body or the second blade body comprises attaching at least one insert selected from the group consisting of a tungsten carbide insert, a diamond insert, an impregnated insert, a polycrystalline diamond compact, and a thermally stable product to at least one of the first blade body or the second blade body.

15. A fixed-cutter earth-boring drill bit, comprising:

a first blade exhibiting a first deflection when subjected to a load, wherein the first deflection is a continuous function of the load; and a second blade exhibiting a second deflection when subjected to the load, wherein the second deflection is a discontinuous function of the load.

16. The fixed-cutter earth-boring drill bit of claim 15, wherein the first blade carries at least one cutting element.

17. The fixed-cutter earth-boring drill bit of claim 15, wherein the second blade carries at least one structure selected from the group consisting of a cutting element, a depth-of-cut limiter, and a wear pad.

18. The fixed-cutter earth-boring drill bit of claim 15, wherein the second deflection is greater than the first deflection for a selected load.

* * * * *